US010784983B2

(12) United States Patent
Giedenbacher

(10) Patent No.: US 10,784,983 B2
(45) Date of Patent: Sep. 22, 2020

(54) ASSEMBLY COMPRISING A NOISE EMITTING ELEMENT

(71) Applicant: CARDLAB APS, Herlev (DK)

(72) Inventor: Robert Bernt Giedenbacher, Herlev (DK)

(73) Assignee: CARDLAB APS, Herlev (DK)

( * ) Notice: Subject to any disclaimer, the term of this patent is extended or adjusted under 35 U.S.C. 154(b) by 0 days.

(21) Appl. No.: 16/474,733

(22) PCT Filed: Oct. 27, 2017

(86) PCT No.: PCT/EP2017/077624
§ 371 (c)(1),
(2) Date: Jun. 28, 2019

(87) PCT Pub. No.: WO2018/121903
PCT Pub. Date: Jul. 5, 2018

(65) Prior Publication Data

US 2019/0327017 A1 Oct. 24, 2019

(30) Foreign Application Priority Data

Dec. 30, 2016 (DK) ..... 2016 71067

(51) Int. Cl.
*H04K 3/00* (2006.01)

(52) U.S. Cl.
CPC ..... *H04K 3/45* (2013.01)

(58) Field of Classification Search
CPC ..... H04K 3/45; H04K 2203/20; H04K 3/86; H04K 3/825; H04K 3/44; H04K 3/41; H04K 2203/32; H04K 2203/34; H04K 3/43; H04K 3/46
USPC ..... 455/522
See application file for complete search history.

(56) References Cited

U.S. PATENT DOCUMENTS

2005/0240778 A1 10/2005 Saito
2006/0187046 A1 8/2006 Kramer
2008/0166962 A1 7/2008 Serbanescu
2009/0209196 A1 8/2009 Haverty
(Continued)

FOREIGN PATENT DOCUMENTS

EP 899682 A2 3/1999
JP 2004/151968 A 5/2004
(Continued)

OTHER PUBLICATIONS

International Search Report PCT/ISA/210 for International Application No. PCT/EP2017/077624 dated Jan. 18, 2018.
(Continued)

*Primary Examiner* — Shaima Q Aminzay
(74) *Attorney, Agent, or Firm* — Harness, Dickey & Pierce, P.L.C.

(57) ABSTRACT

An assembly of a standard RFID/NFC element and a scrambling element for outputting wireless noise in response to a wireless request signal from a terminal, such as NFC, RFID or the like. The scrambling element has a noise generating circuit and an antenna for receiving the request signal and outputting a voltage. The scrambling element further comprises a voltage increasing element receiving the voltage from the antenna and feeding a higher voltage to the circuit to have the circuit start operation faster than the circuit of the standard RFID/NFC element.

14 Claims, 1 Drawing Sheet

(56) References Cited

U.S. PATENT DOCUMENTS

| | | | | |
|---|---|---|---|---|
| 2015/0311998 | A1 | 10/2015 | Harris et al. | |
| 2016/0072611 | A1 * | 3/2016 | Horne ..... | G06K 7/10267 455/1 |

FOREIGN PATENT DOCUMENTS

| | | | |
|---|---|---|---|
| WO | WO-93/05489 | A1 | 3/1993 |
| WO | WO-2005/052846 | A2 | 6/2005 |
| WO | WO-2014/171955 | A1 | 10/2014 |

OTHER PUBLICATIONS

International Preliminary Report on Patentability PCT/IPEA/416 for International Application No. PCT/EP2017/077624 dated Apr. 3, 2019.

* cited by examiner

ASSEMBLY COMPRISING A NOISE EMITTING ELEMENT

CROSS-REFERENCE TO RELATED APPLICATIONS

This application a national phase under 35 U.S.C. § 371 of PCT International Application No. PCT/EP2017/077624, which has an International Filing date of Oct. 27, 2017, which claims priority to Danish Application No. PA201671067 filed Dec. 30, 2016 the entire contents of each of which are hereby incorporated by reference.

The present invention relates to an assembly comprising an element for emitting wireless noise, such as an element for blocking communication with an NFC/RFID terminal to prevent undesired outputting of information from another element, such as a standard, wireless RFID/ID/NFC/payment card, item, token or the like, which is provided to always respond to a seemingly valid request with information which is not desired output to e.g. criminals.

Blocking technology may be seen in WO2005/052846, US2006/187046, US2005/240778, WO2014/171955, WO93/05489, US2008/0166962, EP899682 or JP2004/151968.

A first aspect of the invention relates to an assembly of:

a first wireless communication element comprising:

a first antenna configured to receive a wireless signal and output an output voltage, a first circuit connected to the first antenna and being configured to, when receiving the output voltage, output an output signal to the first antenna, and a second wireless communication element comprising:

a second antenna configured to receive the wireless signal and output a first voltage, a voltage increasing element connected to the second antenna, the voltage increasing element being configured to increase the first voltage by a predetermined factor to a second voltage and output the second voltage, a second circuit connected to the voltage increasing element and being configured to, when receiving the second voltage, output a noise signal to the second antenna, wherein:

the first circuit is configured to start outputting the output signal when the output voltage reaches a first threshold voltage, the second circuit is configured to start outputting the noise signal when the second voltage reaches a second threshold voltage and the first threshold voltage exceeds the second threshold voltage divided by the predetermined factor.

In the present context, the first wireless communication element may be any type of wireless communication element configured to output a signal representing predetermined and/or useful, private, secret, account, identity, access data or the like. The first wireless communication element may be a standard RFID/NFC element, such as an access card/dongle, identity card, credit/debit/purse card, travel card, loyalty card (for use in gas stations, super markets, shops or the like), or the like. However, also other types of elements, such as wireless car keys or a passport may be embodied as the first wireless communication element. Such elements may have the dimensions of a credit card and often are carried on a person, such as in a pocket and/or in a wallet and/or bag/purse. This card or dongle being wireless, it may not need to be removed from the person's pocket/wallet/bag/purse. The mere proximity of the person and thus the first wireless communication element may have the first wireless communication element respond to a wireless signal by outputting another wireless signal related to the output signal. The terminal or the like receiving that wireless signal would then perform the action desired, such as opening/unlocking a door, facilitating a payment, checking in at a train station, unlocking/starting a car, or the like.

The operation of the first wireless communication element may be automatic. Thus, when the first antenna receives a wireless signal, the output voltage may automatically be fed to the first circuit which then, when this voltage is sufficient to power the operation of the first circuit, such as when the output voltage exceeds the first threshold voltage, will output the output signal to the first antenna which will then automatically output a corresponding wireless signal.

Often, the first circuit will, in addition to the output voltage received for powering the operation of the first circuit, derive a signal from the output voltage or from another signal received from the first antenna. This signal may identify a terminal or a terminal type having output the wireless signal. This identity may be derived from information contained in the wireless signal and/or a protocol to which the signal conforms. The protocol may relate to a signal frequency, signal type, encoding type or the like. The first circuit may be configured to output the output signal only when the wireless signal conforms to particular requirements, such as protocol and/or information embedded in the wireless signal under the protocol.

Also, the wireless signal output by the first wireless communication element corresponding to the output signal may be encoded, or the like, to conform to a predetermined protocol. Often, a protocol will specify the frequencies and the like of the wireless communication and/or signal fed to a wireless communication element and that from the wireless communication element.

However, such protocols and information are well-known also to fraudulent persons, and the manufacturing of a false terminal outputting the same information is well within the grasp of fraudulent persons.

In the present context, the second wireless communication element may be shaped as the first communication element, such as as a credit card shaped element, preferably smaller and thinner.

Both communication elements preferably are self powered in the sense that the power needed for operation is derived from the wireless signal received.

The operation of the second wireless communication element is to output the noise signal to the second antenna to have the second antenna output a wireless signal interrupting the usual communication between a terminal and the first wireless communication element, which could be a RFID/NFC/ID/payment card or item, for example. Preferably, the operation of the first wireless communication element may be interrupted or prevented, so that this communication may only take place if actually desired by a person, such as a user or owner of the first wireless communication element.

Preferably, the default operation of the second wireless communication element is to output the noise signal when receiving the wireless signal, so as to prevent the first wireless communication element from communicating at a point in time where the user/owner does not want such communication.

Thus, the operation of the second wireless communication may be automatic. Thus, when the wireless signal is received by the second antenna, the first voltage is automatically fed to the voltage increasing element automatically generating the second voltage and feeding the second voltage to the second circuit which automatically, such as when the second voltage reaches the second threshold voltage, outputs the noise signal to the antenna which then automatically outputs a corresponding wireless noise signal.

In general, an antenna may be a conductor into which an electrical signal is fed and converted into a wireless signal, such as an RF signal. Also, a wireless signal may be received by the antenna and converted into an electrical signal. Often, an antenna is shaped as a coil with a number of windings.

An antenna may be selected to have particular electrical properties, such as a desired inductance, in order to obtain a desired resonance frequency together with a circuit connected to the antenna. Often, the resonance frequency is selected to be at or around a desired frequency, such as a frequency of signals to be received and/or signals to be output.

When an antenna receives a wireless signal, power is output from the antenna. This power will have a voltage—the first voltage or the output voltage. In addition, often the wireless signal will comprise information or data, such as data indicating an identity of the terminal. This information/data may be present as a modulation of the voltage. Naturally, the modulation may be defined by a protocol, such as a packet protocol defining how predetermined information is encoded in the wireless signal. The information may be as simple as a frequency of the wireless signal.

The wireless signal may be output by a terminal as is usual in RFID/NFC/ID/payment card systems where a terminal will output a request RF signal to which neighbouring RFID/NFC/ID items/tokens/payment cards are to respond to in order to initiate a communication resulting in an identification, payment or the like, depending on what the targeted item or token is adapted for.

However, criminals may use concealed terminals to receive such information from ID/RFID/NFC payment cards/items in order to receive the response therefrom so as to later on "re-play" the same response to a legitimate terminal and thus emulate the card/item from which the information was derived. This is to be prevented.

Naturally, the voltage output by an antenna may vary over time. Often, when a signal is received by an antenna, the voltage output of the antenna will build up. Also, the signal strength of the wireless signal may vary, which of course will also affect the voltage output of the antenna. Finally, the voltage will also depend on what is connected to the antenna. A capacitor may be charged by the antenna, whereby the voltage output of the antenna will also depend on the charging state of such a capacitor.

A voltage increasing element is an element receiving one voltage and outputting a higher voltage. The voltage increase is by a predetermined factor exceeding 1. Naturally, a current output of the voltage increasing element may be lower than one received from the antenna. This, however is less of a problem when, which is usually the case, the second circuit primarily starts operation when the voltage fed reaches the second threshold voltage. Using this element thus will make the second circuit start earlier than if the first voltage was applied to it.

Many manners exist of increasing a voltage. A transformer may be used. Other types of useful circuits are charge pumps.

The voltage increase may be selected based on a number of parameters, such as the current available. Naturally, the second circuit will need some current, and the voltage increase may cause the current output of the voltage increasing element to drop correspondingly. Thus, in one situation, the voltage increase may be controlled by a minimum current output thereof to the second circuit. This control may be real-time, programmable and/or be a fixed value.

The voltage increase may be selected so that the second voltage is 1.1 or more times the first voltage (i.e. the factor is 1.1), such as 1.2 or more, 1.5 or more, 1.7 or more, 2 or more, 2.5 or more or the like.

A circuit, such as the first and/or second circuit, may be any type of circuit, monolithic or not. The circuit may comprise an ASIC, controller, DSP, FPGA, processor or the like or be made of discrete components—or a combination thereof. Preferably, the circuit has an energy storage, such as a capacitor, receiving power, such as the output voltage or the second voltage and feeding the remainder of the circuit to allow it to output the output signal or the noise signal, respectively. Often, the antenna cannot receive a wireless signal and thus output the first/output voltage while receiving the noise/output signal. Thus, power is preferably first stored in order to operate the circuit when later outputting the noise/output signal.

The noise signal may be fed directly from the second circuit to the second antenna or via e.g. the voltage increasing element.

In the present context, a noise signal may be a signal which disturbs the communication between e.g. a terminal outputting the wireless signal and the first communication element. Thus, the noise signal may have a frequency component in a frequency band of the wireless signal and/or the desired frequency band of the output voltage and/or a response from the first communication element. The noise signal may be analogue or digital.

In a preferred embodiment, the wireless signal has a frequency of 105.9 kHz and the response (such as the output voltage) from the first communication element has a frequency of 847.5 kHz. Naturally, any frequency may be selected, such as any RF frequency. Different frequencies are used in different protocols.

The noise signal may simply be a periodic signal having a frequency or a frequency component at a desired frequency.

In one situation, this wireless signal output from the second antenna is output at the same time as the wireless signal from the terminal and within the same frequency interval, so that the first communication element may not understand the signal from the terminal and thus not reply thereto.

In another situation, the wireless noise signal is output at the same time as a reply from the first communication element and within the same frequency range, so that the terminal will not be able to discern the contents of the signal from the first communication element. Thus, the combined signal received by the terminal, if any signal is output by the first communication element, may be scrambled to a degree where any information comprised in the signal output of the first communication element may not be derivable.

Preferably, however, the noise signal is output at the same time as the wireless signal from e.g. a terminal so that the receiving first communication element is not able to discern and decode it correctly. In that situation, the first communication element will not output a response at all. Then, the secret information of such a response is not revealed.

The outputting of the noise signal may result in a short circuiting of another wireless signal. Thus, the outputting of the noise signal may short circuit the wireless signal from the terminal so that other antennas in the vicinity of the second antenna, such as the first antenna, do not see, or do not sufficiently see, the wireless signal from the terminal.

In one embodiment, the noise signal is a square signal. An advantage of a square signal is that sharp edges cause the signal emitted by the second antenna to have harmonics extending to other frequencies than the main frequency of the square signal. Thus, noise may be output over an extended frequency range or in a frequency range outside of the main frequency of the square signal. Thus, if the second circuit for example is not able to operate at a sufficiently high frequency, the use of square pulses may nevertheless output noise at a desired, higher frequency.

In this context, a square pulse or signal is a signal with sufficiently sharp edges. Preferably, the rise or fall time from maximum to minimum takes place in less than 10%, such as less than 5%, such as less than 1% such as less than 0.5% of the total period of the signal.

Often, the noise signal is a periodic signal with a duty cycle of 50% or less. In digital signals, the duty cycle is the percentage of a period where the signal is "1" or "high". As will be described below, a lower duty cycle will make the pulses more narrow, causing more harmonics at higher frequencies. Thus, the duty cycle may be selected together with the frequency or period of the noise signal in order to obtain a desired wireless signal output at a given frequency.

Another factor to take into account by the duty cycle is that when the signal output is a binary "0", no signal is output, and the wireless signal may be received by the second antenna, so that the first and therefore the second voltage may be output. Thus, power may be collected for use by the second circuit for outputting the next "1" of the next period of the noise signal.

In one situation, the noise signal comprises a number of pulses, where a width of a pulse is 3 μs or less, such as 2μ or less, such as 1-2 μs. When sufficiently narrow pulses are used, noise is output in frequency bands at multiples (harmonics) of the frequency of the noise signal.

Presently, 1.4 μs pulses are preferred with a duty cycle of 16.7%.

In one situation, a frequency of the noise signal is at least 50% of a predetermined frequency, and wherein the duty cycle is at least 30%. Thus, when the noise signal has a frequency at or close to the desired frequency, a larger duty cycle may be used, as noise may not be needed at higher harmonics. In fact when outputting a noise signal at the frequency of interest, the noise signal need not be square-shaped.

In another situation, where a frequency of the noise signal is less than 50% of a predetermined frequency, the duty cycle preferably is no more than 30%. In that situation, narrower pulses may be desired in order to obtain a wireless noise signal having higher harmonics, such as at frequencies at or near the predetermined frequency.

The purpose of the voltage increasing element is to generate the second voltage which makes the second circuit start outputting the noise signal, before the first circuit starts outputting the output signal.

The first and second circuits are each configured to start outputting the respective output/noise signal when the output/second voltage reaches the first/second threshold voltage, respectively, Often, antennas for the same communication type (protocol and/or frequency) have approximately the same parameters, so that they often output comparable voltages when receiving a wireless signal (where signal strength of the wireless is the same).

However, often the first and second threshold values are not the same. The threshold value of a circuit depends on a number of factors, such as the production method and the like.

Then, when the first threshold voltage exceeds the second threshold voltage divided by the predetermined factor, the second circuit will start operating or at least start outputting the noise signal before the first circuit starts operating and/or starts outputting the output signal.

This may be determined by providing each of the first and second communication elements at a predetermined distance from a terminal and determining the period of time passing between the outputting of the wireless signal to the outputting of the output signal or noise signal—or the period of time lapsing from the first/second antenna receiving the wireless signal and to the outputting of the output signal or the noise signal.

The elements may be tested individually. It is noted that the outputting of the noise signal may additionally interfere with the outputting of the output signal, as the second antenna, when receiving the wireless signal, will have a tendency of at least absorbing part of the energy in the wireless signal. This will delay the point in time at which the first circuit can start, as the signal strength and thus the output voltage, will be lower.

Also, if the outputting of the noise signal is intended to interfere with the reception or interpretation of the wireless signal in the first circuit, the outputting of the noise signal may also in that manner interfere with the outputting of the output signal from the first circuit, as it may altogether prevent the first circuit from outputting the output signal even when operating.

In one embodiment, the second wireless communication element further comprises a voltage limiting element configured to limit the second voltage to a voltage not exceeding a predetermined maximum voltage. Some circuits are not able to handle voltages exceeding a maximum voltage. However, when the first voltage is high, such as if a distance to a terminal outputting the wireless signal is low, the second voltage may exceed this maximum voltage, which could then damage the second circuit. This may be avoided by adding a limiting element. A limiting element may be as simple as a diode, for example.

Naturally, the first wireless communication element may also have a voltage increasing element. In this situation, the first circuit would also start outputting of the output signal at an earlier point in time compared to if simply supplied by the voltage directly from the first antenna. In this situation, the voltage increases of the voltage increasing elements of the first and second communication elements may be adapted to each other so as to ensure that the second circuit still starts before the first circuit—at least when the same wireless signal is received by the two antennas at the same time, such as if the first and second communication elements are positioned beside each other and thus with the same distance to the terminal.

When an electrical signal is fed to an antenna, a corresponding wireless signal will be output from the antenna in the same manner as a wireless signal received by an antenna will generate a corresponding voltage in the antenna. In this context, "corresponding to" will mean that e.g. a frequency present in the wireless signal will also be present in the signal output to/fed to the antenna. Thus, if the wireless signal is modulated, the modulation frequency may also be seen in the signal from the antenna.

In a preferred embodiment, the voltage increasing element has a first and a second terminal, a first, a second and a third capacitor and a first and a second diode, where:

the second and third capacitors are connected in series between a first voltage and a first conductor, the first and second diodes are connected in series between the first voltage and the first conductor, the first capacitor is connected between the first voltage and the first conductor, the first capacitor is configured to feed the second voltage from the first capacitor to the circuit, a terminal of the antenna is connected between the second and third capacitors and another terminal of the antenna is connected between the first and second diodes.

Preferably, the diodes are both directed to guide current from the first voltage, which may be ground, toward the first conductor.

The first conductor may be connected to a power input of the circuit.

In one embodiment, the circuit is configured to output as the noise signal a square signal.

In one embodiment, the noise signal comprises a number of pulses, where a width of a pulse is 3 μs or less, such as 2μ or less, such as 1-2 μs.

In one embodiment, the noise signal is a periodic signal with a duty cycle of 50% or less.

In one embodiment, a frequency of the noise signal is at least 50% of a predetermined frequency, and wherein the duty cycle is at least 30%.

In another embodiment, a frequency of the noise signal is no more than 50% of a predetermined frequency, and wherein the duty cycle is no more than 30%.

In one embodiment, the first and second wireless communication elements have the same overall shape, such as a shape resembling a credit card or a dongle/fob/tag to be attached to e.g. a key chain. Then, the first and second elements may be carried or transported together, such as in a key chain or in a wallet, so that the second element is carried together with the first element in order to be able to carry out its operation and thus protect the information in the first element. Ultimately, the first and second wireless communication elements may be built into the same element, such as a credit card shaped element, a pass port, key fob or the like.

Naturally, sometimes the output signal of the first element is actually desired converted into a wireless signal to be received by a terminal. In that situation, the second circuit may be disabled, such as by preventing the second voltage from feeding the circuit, by reducing the voltage fed to a lower voltage, by preventing the noise signal from reaching the second antenna, or the like. This disabling may be user initiated such as by operating a switch or other operable element.

Another aspect of the invention relates to a method of operating an assembly, such as an assembly according to the first aspect of the invention, comprising:

a first wireless communication element comprising a first antenna and a first circuit and a second wireless communication element comprising a second antenna, a voltage increasing element and a second circuit, the method comprising the steps of:

1. an emitter outputting a wireless signal,
2. the first and second antennas receiving the wireless signal and outputting an output voltage and a first voltage, respectively,
3. the voltage increasing element receiving the first voltage and outputting a second voltage, the second voltage being larger than the first voltage and
4. the first and second circuits receiving the output voltage and the second voltage, respectively, and outputting an output signal and a noise signal, respectively, to the first and second antennas, respectively, where the second circuit starts outputting the noise signal before the first circuit starts outputting the output signal.

This may be the situation where the main function of the noise signal is to scramble the signal output from the first element.

A third aspect of the invention relates to a method of operating an assembly, such as an assembly according to the first aspect of the invention, comprising:

a first wireless communication element comprising a first antenna and a first circuit and a second wireless communication element comprising a second antenna, a voltage increasing element and a second circuit, the method comprising the steps of:

1. an emitter outputting a wireless signal,
2. the first and second antennas receiving the wireless signal and outputting an output voltage and a first voltage, respectively,
3. the voltage increasing element receiving the first voltage and outputting a second voltage, the second voltage being larger than the first voltage and
4. the first and second circuits receiving the output voltage and the second voltage, respectively,
5. the second circuit outputting a noise signal to the second antenna, without the first circuit outputting an output signal to the first antenna.

This may be the situation where the operation of the second element is to output a signal interfering with the wireless signal from the terminal so that the first circuit does not output any output signal as it cannot ascertain that the wireless signal from the terminal conforms to a desired protocol.

Naturally, the first, second and third aspects may be combined, and all embodiments and elements of the first aspect are equally valid in this respect.

In this context, an emitter outputting the wireless signal may be any type of emitter, such as a standard RFID/NFC terminal, such as that of a ATM, a door access system, a payment terminal, a mobile telephone, or other elements used for identifying or recognizing a wireless element or token, such as an ID card, access card, payment card, ticket, or the like The wireless signal may be a HF/UHF signal and/or a signal used in RFID and/or NFC.

Preferably, step 2 comprises the first and second antennas receiving the wireless signal at the same time. Then, the first and second antennas and thus wireless communication elements may be at the same distance to the emitter for this determination. Naturally, these distances need not be identical. One of the first and second antennas may be up to 10% farther away from the emitter than the other, but preferably, the distances are within 5%, such as within 2% or 1% of the largest distance. This will make one antenna receive the wireless signal slightly before the other, but this may be taken into account when dimensioning or selecting the voltage increasing element. It is noted that the power of the wireless field reduces with the distance cubed, so a distance difference will affect the voltage output from the antenna more than the altered travelling time of the wireless signal.

As described above, the operation and steps of the individual elements may be automatic so that when receiving the wireless signal, the generation of the voltage and the output of the signal is automatic, if the voltage is sufficient. Thus, the operation of the noise signal is to scramble or disturb the signal output of the first antenna.

The second circuit starts the outputting of the noise signal before the first circuit starts outputting the output signal. Thus, the second circuit may prevent the first circuit from outputting the signal altogether. It may suffice that the circuits start at the same time, but it may be desired to ensure that the noise signal is output first in order to ensure that the signal output of the first circuit is not comprehensible.

The controlling of the relative points in time of outputting may be a controlling of the time intervals required from an antenna receives the wireless signal and until the signal is output from the circuit. The voltage increase is a manner of starting a circuit faster, as the circuits often start operating when the voltage fed thereto exceeds a threshold value. Thus, the voltage increase will ensure that the second circuit starts earlier than if the voltage increase was not performed.

The voltage increase then may be tailored or selected to ensure that the second circuit starts sufficiently early.

It is noted that the first circuit may also itself cause a delay in the outputting of the output signal, compared to the processing time required by the second circuit from the start of operation to the outputting of the noise signal. The first circuit may analyse the output voltage or information comprised therein to determine whether to output the output signal at all. The first circuit may compare the information of the voltage or other information derivable from the voltage to predetermined information to make the decision. The first circuit may determine whether the output voltage or information therein conforms to a predetermined protocol and output the output signal only if this protocol is adhered to.

Thus the first circuit may itself decide to not output the output signal even if receiving a wireless signal, if the wireless signal adheres to a wrong protocol, such as if the wireless signal has a carrier frequency falling outside of a predetermined frequency interval.

This analysis of the output voltage may delay the first circuit to a degree where the second circuit has started outputting the noise signal. This delay may be taken into account when dimensioning or selecting the voltage increase.

In one embodiment, the second voltage is at least 2 times the first voltage.

In one embodiment, the noise signal is a square signal and/or the noise signal comprises a number of pulses, where a width of a pulse is 3 μs or less.

In one embodiment, the noise signal is a periodic signal with a duty cycle of 50% or less.

In one embodiment:

- a frequency of the noise signal is at least 50% of a predetermined frequency, and wherein the duty cycle is at least 30% or
- a frequency of the noise signal is no more than 50% of a predetermined frequency, and wherein the duty cycle is no more than 30%.

In one embodiment, in step 2, the output voltage is no less than 90% of the first voltage and no more than 110% of the first voltage.

In one embodiment, step 4 comprises the step of limiting the second voltage to a voltage not exceeding a predetermined voltage before feeding the limited voltage to the second circuit.

In the following, preferred embodiments of the invention will be described with reference to the drawing, wherein.

Figure 1:
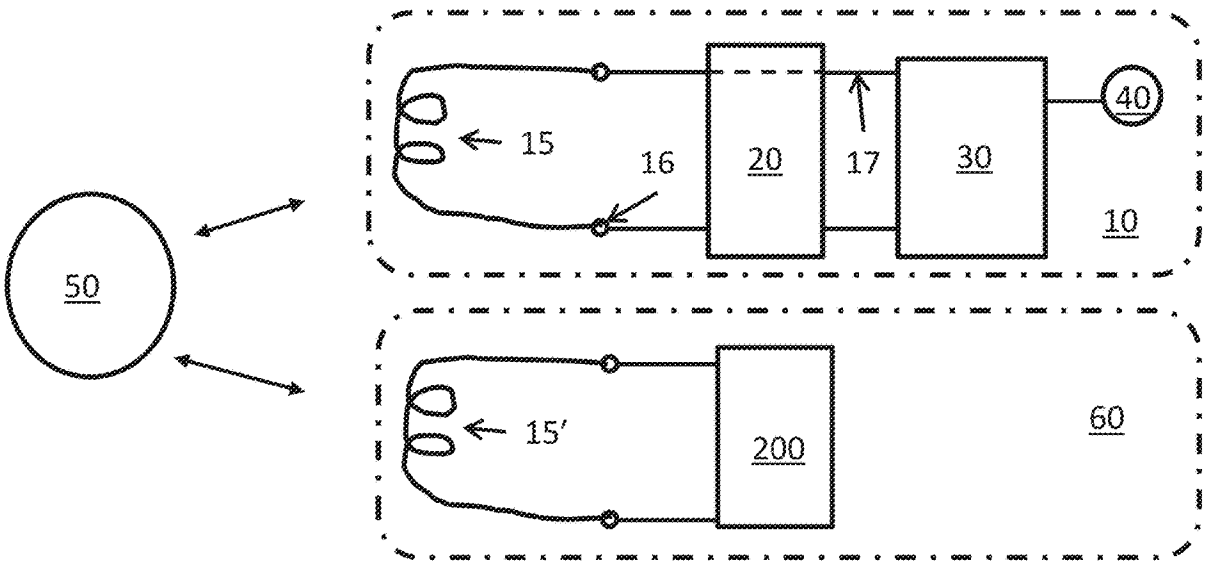
FIG. 1 illustrates a preferred embodiment according to the invention.

In FIG. 1, an assembly is illustrated having a standard RFID/NFC card 60, such as a credit card or an ID card, having an antenna 15' and a circuit 200, and an element, such as a thin, credit card shaped element 10 which has an antenna 15 connected to a voltage increasing element 20 via terminals 16 and which is again connected to a noise generating circuit 30 via connections 17.

The antenna 15 may be a standard coil used for NFC or RF communication, such as for RFID communication or other wireless communication often used for identification, payment or similar purposes. The antenna 15' may be the same type of antenna or another type of antenna—but again may be a standard antenna type.

The circuit 200 is connected to the antenna 15' in the standard manner. When receiving a wireless signal from the reader 50, the antenna will output an output voltage to the circuit, which derives power from this signal and generates an output signal to the antenna 15'. The output signal usually comprises identity information and/or other sensitive information for a genuine or trustworthy reader 50 to receive.

However, fraudulent readers 50 may exist which will attempt to access this output signal to illegally use that information against the will of the owner. This is to be avoided.

The circuit 30 may be connected to the element 20 only, or one terminal thereof may be connected directly to the coil if desired (hatched line).

The circuit 30 is configured to output, when powered, a noise signal (see below) in order to prevent or block communication between the RFID/NFC terminal 50 and the RFID/NFC element 60, which is also in the vicinity of the element 10.

When the terminal 50 outputs its usual request signal, the antenna of the element 10, as in usual ID/payment cards, will receive the signal and output power and thus a voltage. In usual RFID/NFC elements, this power is fed to a chip 200 which then will operate to respond to the request signal with an identification of the RFID/NFC element. The element 60 may be a standard RFID/NFC element.

However, such responses may not always be desired, whereby blocking or prevention of this communication is desired. It is not practical to prevent the terminal 50 from outputting the signal, and in some situations, criminals will carry terminals in crowded spaces, such as trains, in order to obtain information from RFID/NFC elements 60. Thus, the terminals 50 are not controllable or trustworthy to the desired extent.

The present element 10, however, will, when sensing a signal from a terminal 50, itself output a noise signal aimed at preventing near-by NFC/RFID elements 60, such as ID or payment cards, from either receiving or correctly interpreting the terminal request signal (the NFC/RFID elements usually only respond to a request signal complying to a given standard or protocol), or at outputting a signal scrambling any signal output by the NFC/RFID elements 60.

As the energy obtainable from a request signal depends a lot on the distance between the terminal antenna and the antenna of the elements 10/60, it is highly desired that the present element 10, at least when positioned at the same distance to the terminal 50 as the element 60, is faster than the NFC/RFID element 60 in order to ensure that the scrambling or noise emitting starts so early that the NFC/

RFID element 60 does not have time to output its response, before the noise signal is output.

The chip 30 will start operating when the voltage fed thereto reaches a threshold voltage. The voltage output of the coil 15 will increase, as the field is detected and the power collected increases. The operation of the voltage increasing element 15 is to receive the power and voltage output of the antenna 15 and increase the voltage and feed this increased voltage to the circuit 30. As a result thereof, the circuit 30 will start operation earlier and thus be faster to perform its preventing/blocking action compared to the circuit 200 not having this "voltage boost".

In some circumstances, however, it is actually desired to have the ID or payment card 60 respond to a terminal request signal, such as when entering a secured door or making a payment. Thus, it is desired to be able to prevent the operation of the circuit 30. To this effect, a switch or other user operable element 40 may be provided. The user may operate this element 40 and thereby send a signal to the circuit 30 to not operate.

The element 40 may be a standard switch, a wireless receiver for signals output by e.g. a mobile telephone of the user, or a piezo element outputting a voltage when bent, so that the user need only deform (or just tap) the element 10 to stop the noise outputting operation.

The noise outputting operation may be carried out in many manners. In one embodiment, the noise outputting step comprises the outputting of sharp pulses, such as square pulses. The advantage of such sharp pulses or sharp corners is that these will generate an output not only at the frequency of the pulses but also at harmonics thereof. Thus, a noise signal with a wider spectrum may be output.

Usually, the request signal from the terminal 50 is 105.9 kHz and the response from a RFID/ID/NFC card 60 is 847.5 kHz. In principle, the noise signal may operate in any of these frequency bands.

In one situation, the noise signal has a frequency within 10% of one of the above frequency bands. However, it is also possible to provide a noise signal with a frequency lower than one of the frequency bands, especially if the pulse width of the signal is reduced. Lower pulse widths create more harmonics which therefore will also create noise at higher frequencies.

Also, the duty cycle may be selected. It is noted that a low duty cycle outputs the signal only during a lower proportion of the period of the signal. In the remaining portion of the period of the signal, no signal is output, whereby power may be collected by the element 10 for continued operation of the circuit 30.

Thus, a duty cycle of at least 30%, such as at least 40%, such as around 50% may be selected especially if the frequency of the noise signal is at or at least within 20% or 10% of the desired frequency, whereas a duty cycle of no more than 30%, such as no more than 20%, such as no more than 15% may be desired, if the frequency of the frequency to be blocked is at least twice the frequency of the noise signal.

Figure 2:
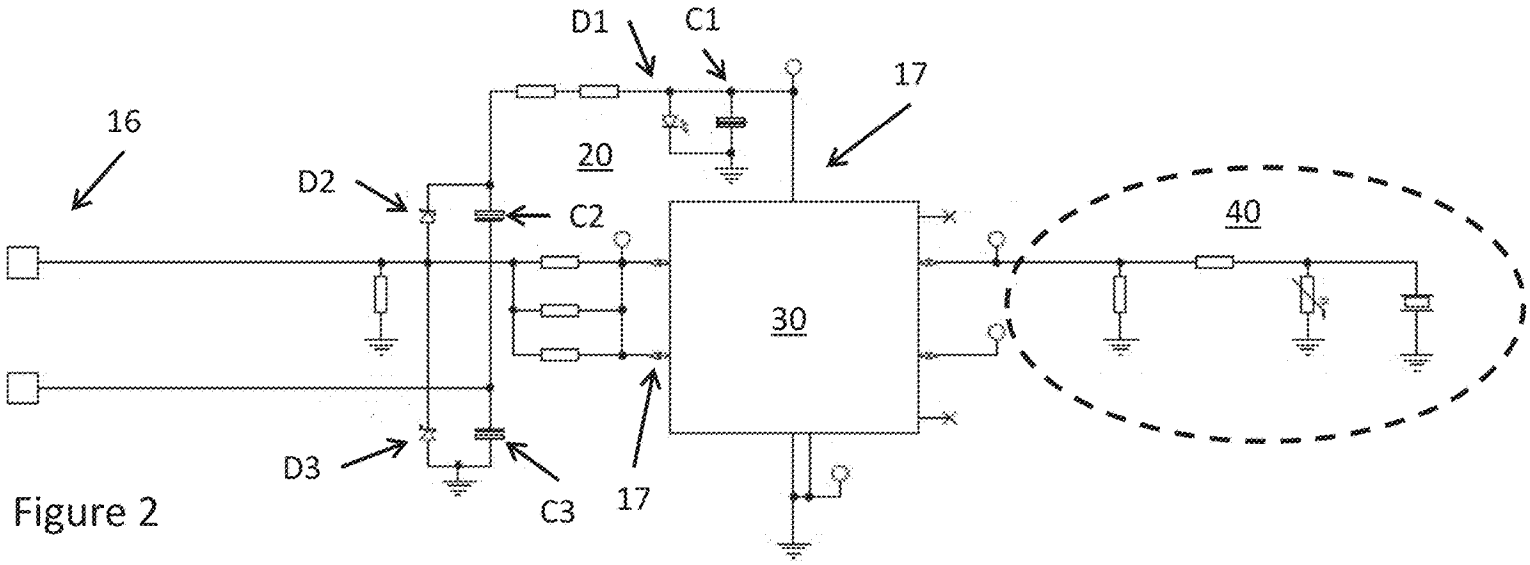
FIG. 2 illustrates an embodiment of the voltage increasing element.

FIG. 2 illustrates a preferred embodiment of the voltage increasing element 20. The element is provided to the left of and at the top of the circuit 30. To the right, the sensor 40 is illustrated, here in the form of a piezo element and a variable resistor in addition to a voltage divider all provided to protect the circuit 30 from the high voltage potentially output of the piezo.

The element 20 receives the signal from the terminals 16 and feeds the signal from the upper terminal (through a resistor) to the circuit 30. This signal is fed between two diodes, D2 and D3 provided between an output and ground.

The signal from the lower terminal is fed between two capacitors, C2 and C3, also provided between ground and the output.

The operation of this set-up is that when the signal is positive on the upper terminal and thus negative on the lower terminal, D2 will be conducting while the diode D3 will be blocking, so the voltage across C2 will build up.

When, on the other hand, the signal is negative on the upper terminal and positive on the lower terminal, D3 will be conducting while the D2 will be off, so the voltage across C3 will build up.

The voltage output is fed to the capacitor C1 which holds the voltage fed to the circuit 30 for operation. A LED D1 is provided for protecting the circuit 30 from any excessive voltage output of the capacitor C1. D1 may be dimensioned to be conducting at a voltage close to the max voltage for the circuit 30. D1 may of course be replaced by any other circuit having the same effect, such as a circuit disposing of the power by creating heat (a resistor).

Ignoring the voltage drop in D2 and D3, the voltage across both C2 and C3 will be that received from the coil, i.e. the first voltage, V. Then, the voltage fed to C1, the second voltage, is the voltage across C2+the voltage across C3, i.e 2*V. This circuit thus acts as a voltage doubler.

When operating, the circuit 30 outputs the noise signal to the upper terminal and thus to the antenna.

The element 10 preferably is provided in the vicinity of the RFID/ID/NFC/payment cards or items to protect. The element 10 may be embodied as a thin element which may be glue to a wireless card, for example, to protect or to e.g. a wallet or other holder for such cards.

Any voltage increase may be selected. As mentioned above, the voltage increasing circuit may be implemented in a number of manners, including in discrete components. Some examples are:

http://www.circuitstoday.com/voltage-doubler-circuit-using-ne555 http://www.electronics-tutorials.ws/blog/voltage-multiplier-circuit.html

Naturally, the element 60 may also have a voltage increasing element as that of the element 10. A reason for increasing the voltage fed to the circuit 200 may be to increase the range thereof. In this situation, the voltage increasing element 20 of the element 10 should be adapted (or the threshold voltage of the circuit 30), so that the circuit 30 nevertheless will reach its threshold voltage before the circuit 200 does.

The invention claimed is:

1. An assembly of:

a first wireless communication element comprising:

a first antenna configured to receive a wireless signal and output an output voltage, the wireless signal having a wireless signal frequency, a first circuit connected to the first antenna and being configured to, when receiving the output voltage, output an output signal to the first antenna, the first antenna being configured to output, based on the output signal, a wireless output signal having an output frequency, and a second wireless communication element comprising:

a second antenna configured to receive the wireless signal and output a first voltage, a voltage increasing element connected to the second antenna, the voltage increasing element being configured to increase the first voltage by a predetermined factor to a second voltage and output the second voltage, a second circuit connected to the voltage increasing element and being configured to, when receiving the second voltage, output a noise signal to the second antenna, the second antenna being configured to, on the basis of the noise signal, output a wireless noise signal having a frequency component in a frequency band of the wireless signal frequency or the output signal frequency, wherein:

the first circuit is configured to start outputting the output signal when the output voltage reaches a first threshold voltage, the second circuit is configured to start outputting the noise signal when the second voltage reaches a second threshold voltage and the first threshold voltage exceeds the second threshold voltage divided by the predetermined factor.

2. An assembly according to claim 1, where the voltage increasing element has a first and a second terminal both connected to the second antenna, a first, a second and a third capacitor and a first and a second diode, where:

the second and third capacitors are connected in series between a predetermined voltage and a first conductor, the first terminal is connected between the second and third capacitors, the first and second diodes are connected in series between the predetermined voltage and the first conductor, the second terminal of the coil is connected between the first and second diodes, and the first capacitor is connected between the predetermined voltage and the first conductor, the first capacitor being configured to feed the second voltage from the first capacitor to the circuit.

3. An assembly according to claim 1, wherein the second circuit is configured to output as the noise signal a square signal and/or the noise signal comprises a number of pulses, where a width of a pulse is 3 μs.

4. An assembly according to claim 1, wherein the noise signal is a periodic signal with a duty cycle of 50% or less.

5. An assembly according to claim 1, wherein:

a frequency of the noise signal is at least 50% of a predetermined frequency, and wherein the duty cycle is at least 30% or a frequency of the noise signal is no more than 50% of a predetermined frequency, and wherein the duty cycle is no more than 30%.

6. An assembly according to claim 1, wherein the second wireless communication element further comprises a voltage limiting element configured to limit the second voltage to a voltage not exceeding a predetermined maximum voltage.

7. A method of operating an assembly comprising:

a first wireless communication element comprising a first antenna and a first circuit and a second wireless communication element comprising a second antenna, a voltage increasing element and a second circuit, the method comprising the steps of:

1. an emitter outputting a wireless signal,
2. the first and second antennas receiving the wireless signal and outputting an output voltage and a first voltage, respectively,
3. the voltage increasing element receiving the first voltage and outputting a second voltage, the second voltage being larger than the first voltage and
4. the first and second circuits receiving the output voltage and the second voltage, respectively, and outputting an output signal and a noise signal, respectively, to the first and second antennas respectively, the first and second antennas outputting, based on the output signal and noise signal, respectively, a wireless output signal having an output frequency and a wireless noise signal, respectively, where the wireless noise signal has a frequency component in a frequency band of the output signal and wherein the second circuit starts outputting the noise signal before the first circuit starts outputting the output signal.

8. A method according to claim 7, wherein the second voltage is at least 2 times the first voltage.

9. A method according to claim 7, wherein the noise signal is a square signal and/or the noise signal comprises a number of pulses, where a width of a pulse is 3 μs or less.

10. A method according to claim 7, wherein the noise signal is a periodic signal with a duty cycle of 50% or less.

11. A method according to claim 7, wherein:

a frequency of the noise signal is at least 50% of a predetermined frequency, and wherein the duty cycle is at least 30% or a frequency of the noise signal is no more than 50% of a predetermined frequency, and wherein the duty cycle is no more than 30%.

12. A method according to claim 7, wherein, in step 2, the output voltage is no less than 90% of the first voltage and no more than 110% of the first voltage.

13. A method according to claim 7, wherein step 4 comprises the step of limiting the second voltage to a voltage not exceeding a predetermined voltage before feeding the limited voltage to the second circuit.

14. A method of operating an assembly comprising:

a first wireless communication element comprising a first antenna and a first circuit, the first circuit being configured to check whether a signal received from the first antenna conforms to predetermined requirements and, only if so, to output an output signal to the first antenna and a second wireless communication element comprising a second antenna, a voltage increasing element and a second circuit, the method comprising the steps of:

1. an emitter outputting a wireless signal having a wireless signal frequency,
2. the first and second antennas receiving the wireless signal and outputting an output voltage and a first voltage, respectively,
3. the voltage increasing element receiving the first voltage and outputting a second voltage, the second voltage being larger than the first voltage and
4. the first and second circuits receiving the output voltage and the second voltage, respectively,
5. the second circuit outputting a noise signal to the second antenna, without the first circuit outputting an output signal to the first antenna, so that the antenna outputs a wireless noise signal having a frequency component in a frequency band of the wireless signal.

* * * * *